US009920548B2

(12) United States Patent
Ojeda González-Posada et al.

(10) Patent No.: US 9,920,548 B2
(45) Date of Patent: Mar. 20, 2018

(54) KEY AND LOCK

(71) Applicant: URBANALPS AG, Zürich (CH)

(72) Inventors: Alejandro Ojeda González-Posada, Baden (CH); Felix Michael Reinert, Wettingen (CH)

(73) Assignee: URBANALPS AG (CH)

( * ) Notice: Subject to any disclaimer, the term of this patent is extended or adjusted under 35 U.S.C. 154(b) by 0 days.

(21) Appl. No.: 15/028,504

(22) PCT Filed: Oct. 8, 2014

(86) PCT No.: PCT/CH2014/000146

§ 371 (c)(1),
(2) Date: Apr. 11, 2016

(87) PCT Pub. No.: WO2015/051475

PCT Pub. Date: Apr. 16, 2015

(65) Prior Publication Data

US 2016/0290007 A1 Oct. 6, 2016

(30) Foreign Application Priority Data

Oct. 11, 2013 (CH) ..... 1740/13
Apr. 25, 2014 (CH) ..... 631/14

(51) Int. Cl.
*E05B 19/00* (2006.01)
*E05B 29/00* (2006.01)
(Continued)

(52) U.S. Cl.
CPC ..... *E05B 19/0023* (2013.01); *E05B 19/0041* (2013.01); *E05B 29/0013* (2013.01);
(Continued)

(58) Field of Classification Search
CPC ..... E05B 27/00; E05B 27/0082; E05B 19/00; E05B 29/0013; E05B 19/0041;
(Continued)

(56) References Cited

U.S. PATENT DOCUMENTS 494,340 A 3/1893 Meinke
587,603 A 8/1897 Piccioni
(Continued)

FOREIGN PATENT DOCUMENTS

CN 101956489 A 1/2011
CN 102877709 A 1/2013
(Continued)

OTHER PUBLICATIONS

International Search Report dated Jan. 19, 2015 issued in corresponding International patent application No. PCT/CH2014/000146.

(Continued)

*Primary Examiner* — Suzanne L Barrett
(74) *Attorney, Agent, or Firm* — Ostrolenk Faber LLP

(57) ABSTRACT

A key including at least one coding cavity (55) defining a hollow geometry for coding the key. The geometry includes at least one internal undercut (60*a*, 60*b*). The lock for validating a key comprises blocking means (21, 22) coupled to a driving part (14) and validating means (25, 26) which are coupled to the blocking means so as to change the state of the blocking means when the key used with the lock has a correct coding. The validating means (25, 26) protrude at least partially into the key cavity of the lock in order to introduce the validating means at least partially into the coding cavity (55) of the key and to sense the inner face of the coding cavity.

32 Claims, 16 Drawing Sheets

(51) Int. Cl.
*E05B 47/00* (2006.01)
*E05B 49/00* (2006.01)

(52) U.S. Cl.
CPC ..... *E05B 19/0047* (2013.01); *E05B 19/0058* (2013.01); *E05B 29/0066* (2013.01); *E05B 47/0045* (2013.01); *E05B 49/006* (2013.01)

(58) Field of Classification Search
CPC ..... E05B 19/0023; E05B 47/0045; E05B 49/006; E05B 19/0047; E05B 19/0058; E05B 29/0066; Y10T 70/7847
USPC ..... 70/366, 395–409
See application file for complete search history.

(56) References Cited

U.S. PATENT DOCUMENTS 991,363 A * 5/1911 Polsen ..... E05B 65/0811 70/401
1,373,897 A * 4/1921 Lotz ..... E05B 19/00 70/393
1,616,255 A * 2/1927 Douglas ..... B60R 25/04 70/366
2,039,126 A * 4/1936 Svoboda ..... E05B 29/00 70/340
3,722,240 A 3/1973 Spain et al.
3,754,422 A 8/1973 Stackhouse ..... 70/364 R
4,083,212 A * 4/1978 Proefrock ..... E05B 17/0062 70/366
RE30,198 E 1/1980 Oliver et al.
4,351,172 A * 9/1982 Martikainen ..... E05B 21/066 70/366
4,359,886 A * 11/1982 Evans ..... E05B 21/066 70/366
4,370,875 A * 2/1983 Piiroinen ..... E05B 21/066 70/366
4,392,134 A * 7/1983 Lutz ..... C03C 3/064 340/5.22
4,418,555 A * 12/1983 Uyeda ..... E05B 21/066 70/324
4,667,495 A * 5/1987 Girard ..... E05B 19/0017 70/358
4,841,758 A * 6/1989 Ramblier ..... E05B 47/0044 70/276
4,977,767 A * 12/1990 Prunbauer ..... E05B 27/0082 70/406
5,067,335 A 11/1991 Widén
5,131,247 A * 7/1992 Hsu ..... E05B 19/18 70/358
5,170,651 A * 12/1992 Errani ..... E05B 35/004 70/395
5,372,024 A * 12/1994 Ruckert ..... E05B 19/0035 70/401
6,109,073 A * 8/2000 Parsons ..... E05B 19/00 70/16
6,591,645 B1 * 7/2003 Wittwer ..... E05B 21/066 70/366
6,758,074 B1 * 7/2004 Prunbauer ..... E05B 19/0017 70/366
6,925,844 B2 * 8/2005 Liu ..... E05B 35/06 70/358
7,353,675 B1 * 4/2008 Chao ..... E05B 27/0035 70/358
7,424,815 B1 * 9/2008 Pagnoncelli ..... E05B 29/004 70/340
7,665,336 B2 2/2010 Widén
8,061,168 B2 11/2011 Widén
8,276,419 B2 * 10/2012 Farrenkothen ..... E05B 29/00 70/377
9,097,035 B2 * 8/2015 Litwinski ..... E05B 35/14
9,435,140 B2 * 9/2016 Chen ..... E05B 27/0057
2008/0066508 A1 3/2008 Chao et al.
2013/0152648 A1 * 6/2013 Havemann ..... E05B 29/00 70/492
2013/0170693 A1 * 7/2013 Marsh ..... G05B 15/02 382/100
2015/0332533 A1 * 11/2015 Meganck ..... G07C 9/00309 340/5.61
2016/0167114 A1 * 6/2016 Haake ..... B22C 7/02 164/69.1

FOREIGN PATENT DOCUMENTS

CN 203050277 U 7/2013
CN 203891596 U 10/2014
WO WO 89/06733 A1 7/1989
WO WO 2006/098675 A1 9/2006

OTHER PUBLICATIONS

International Search Report, dated Jul. 26, 2016, issued in corresponding International Application No. PCT/EP2016/057486. Total 3 pages.
Search Report dated Dec. 7, 2016 in corresponding Czech Republic Patent Application No. PV 2016-529 (total 3 pages).
Notification of the First Office Action with Search Report dated May 24, 2017 in corresponding Chinese Patent Application No. 201480056004.X (with English language translation)(total 20 pages).

* cited by examiner

Fig. 40b
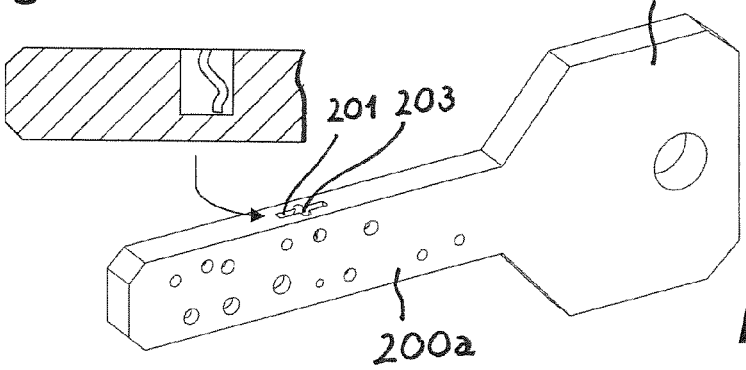
Fig. 40a
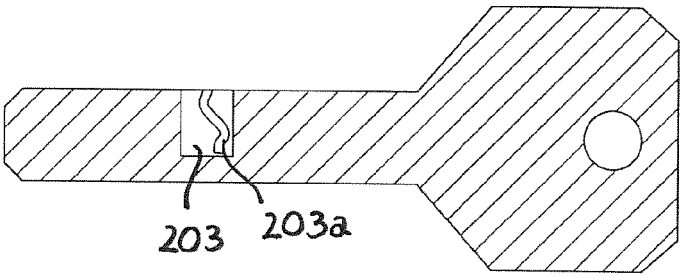
Fig. 40c
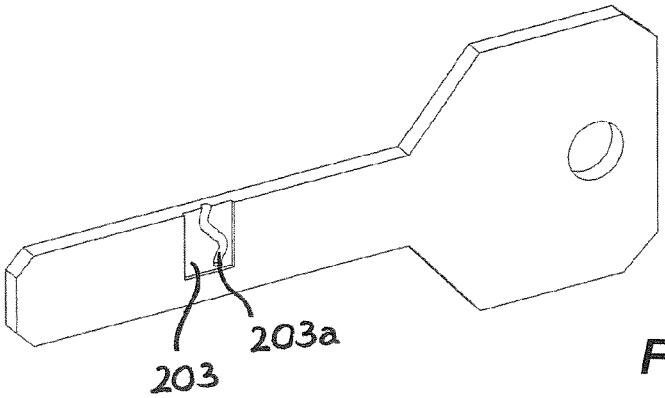
Fig. 40d

Fig. 43b
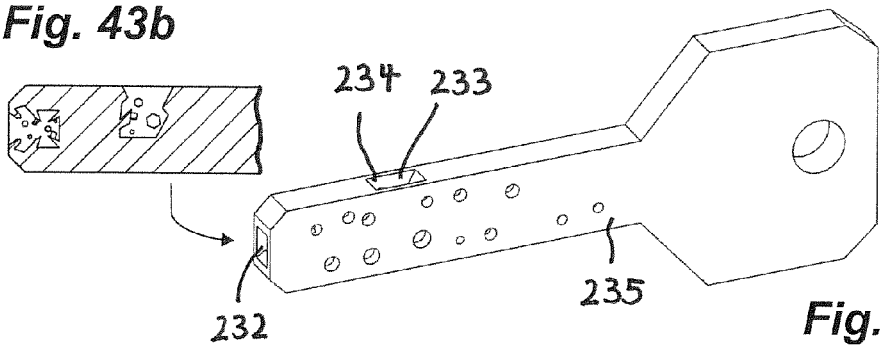
Fig. 43a
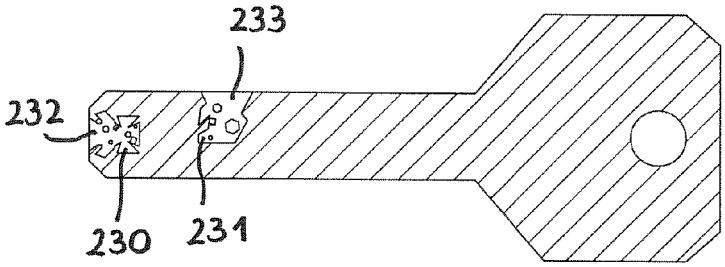
Fig. 43c
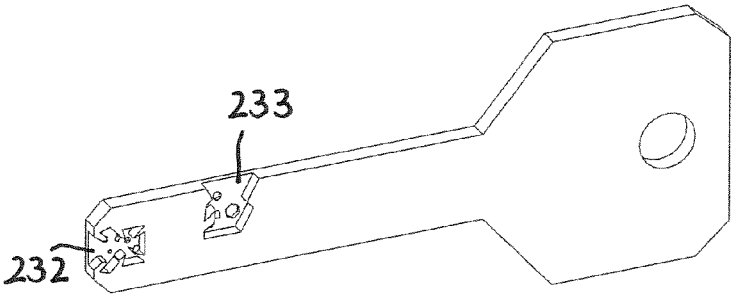
Fig. 43d

Fig. 44b
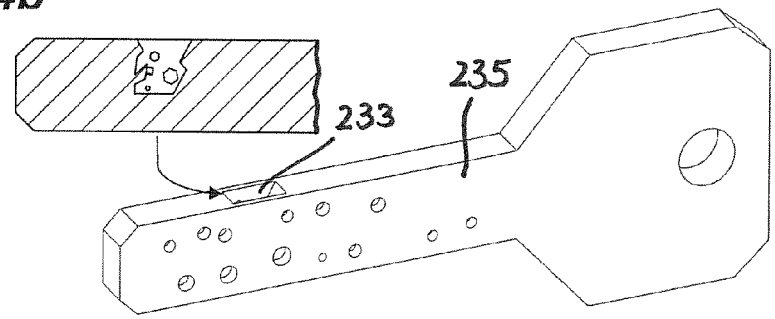
Fig. 44a
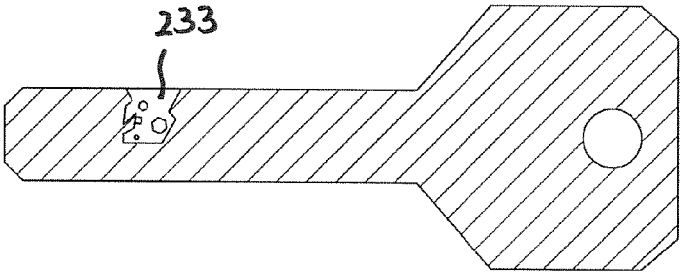
Fig. 44c
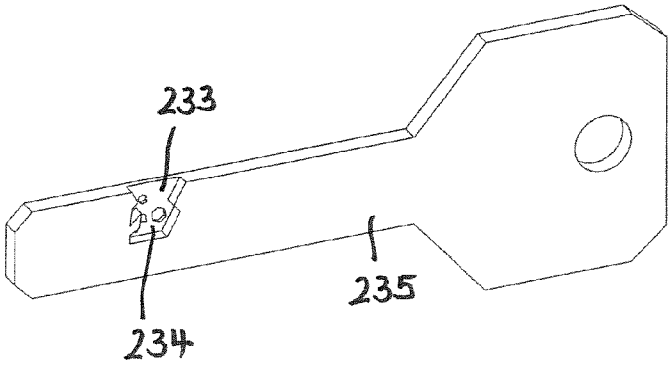
Fig. 44d

KEY AND LOCK

CROSS REFERENCE TO RELATED APPLICATIONS

The present application is a 35 U.S.C. § 371 National Phase conversion of PCT/CH2014/000146, filed Oct. 8, 2014, which claims the benefit of Swiss patent application no. 1740/13, filed Oct. 11, 2013 and Swiss patent application no. 631/14, filed Apr. 25, 2014, the disclosures of which are incorporated herein by reference. The PCT International Application was published in the English language.

TECHNICAL FIELD OF THE INVENTION

The present disclosure relates to a key and a lock.

Background

Many significant technical improvements in cylinder lock art have been introduced into the market in the last two or three decades. These have had the purpose, among others, of increasing the number of lock combinations and/or the complexity of key duplication.

Typically, improvements in increasing the number of keying combinations have been obtained by:

- Increasing the number of tumbler pins and holes.
- Producing keys with very complex shapes or variations in the key profiles and the corresponding keyway in the cylinder.
- Varying the shapes of tumbler pins and drivers.

Such improvements have also made lock picking techniques, including impression methods of producing false keys, more difficult.

Cylinder locks have also been constructed to make the reproduction of keys more complex. Such improvements have mainly consisted of unique shaped bittings and the variation of the axial and radial orientations of each tumbler pin and driver pair. As a result, keys with different shapes have been constructed (i.e. flat keys, crown-shaped keys, nailed-shaped keys, etc.).

Despite improvements in the well-designed cylinder lock art, the security of these locks is still limited due to, among others, the following factors:

- Unauthorized duplications may be easily obtained by use of conventional machines that operate on the premise of the key having one or two axes;
- At present, keys have a simple design and structure whose external features may be easily interpreted by an expert and may also be reproduced by impression methods or even by use of simple cutting tools.

The limited number of keying combinations is due to a series of factors such as: a) the market demand for small and thin keys, which reduce the range of lock components; b) key production being based only on one or two dimensions: the axial positioning and the depth of the key bittings; c) the technical limitation of increasing the number of tumbler pins above a certain quantity, without increasing the cost and complexity of the lock.

Once again, lock-picking techniques are possible and the security of the lock is decreased because the keys have only two dimensions and therefore, can be easily copied by exploiting the geometrical and positional tolerance of various components. Into this technological background entered the U.S. Pat. No. 3,722,240 and U.S. Pat. RE 30,198. These patents greatly improved the state of the cylindrical lock art by introducing the principle of "angular positioning of tumbler pins", or a "double locking system". The improvement is based on the introduction of the rotational positioning of the tumbler pins, in addition to the traditional elevational positioning of the pins. This factor significantly increased the number of available keying combinations.

Increasing the number of key bittings incrementally resulted in a higher number of unique keys, greatly reducing the possibility of a key operating a cylinder other than its own. This improvement also rendered key duplication possible only by means of special machines, able to reproduce not only the depth but also the angular positioning of the bittings.

Notwithstanding the above mentioned technological progress in this field, the current market demands a more sophisticated and secure key and lock system, with a new concept of geometries and which does neither allow easy access to the security features nor permit its reproduction with conventional machines.

SUMMARY OF THE INVENTION

It is an object of the present disclosure to provide for a key which has an increased safety level with respect to duplication and to provide for a lock usable with such a key.

For solving the object, a key according to in claim 1 is provided. Also, a lock according to claim 13 is provided. According to claim 26, a method for fabricating a key is provided. The further claims specify additional embodiments of the key, the method and the lock, and a use of means for validating the key.

According to an aspect, a key comprises at least one coding cavity defining a hollow geometry for coding the key, wherein the hollow geometry includes at least one internal undercut.

According to another aspect, a method for fabricating a key is provided, in which an additive manufacturing process is applied.

According to a further aspect, a lock comprises a housing with a key cavity for introducing the key and validating means, which protrude at least partially into the key cavity in order to introduce the validating means at least partially into the coding cavity of the key and to sense the inner face of the coding cavity. The lock is suitable for validating the key of the present disclosure.

In contrast to mechanical security keys known in the art, at least some of the security features may not be exposed to the user, so that they are not easily seen or even not visible at all.

The key may comprise a wall, which defines at least one coding cavity. At least one internal undercut may be made integral with the wall. The wall may be solid and/or made of one piece, for instance by means of an additive manufacturing process.

At least one internal undercut may extend less than 360 degrees around an extension direction, in which at least one coding cavity extends. Thereby, one or more free spaces are provided, which allows a lock to be configured such that the key can be validated by inserting it into the lock, wherein it is moved in a linear direction.

The key may comprise at least one coding path in form of a linear structure. The coding path may be defined by opposing sides. The sides may be non-circumferential, i.e. extend less than 360 degrees around the wall defining the at least one coding cavity. The sides may extend in the at least one cavity from a first end to a second end along a non-straight course for forming at least one undercut, the second end being spaced away from the first end.

The opposing sides of the coding path may define a channel, a ridge or a line of one or more channel sections and one or more ridge sections, e.g. a first channel section followed by a ridge section. Thereby, the coding path is formed in the wall as a negative and/or positive structure. The intermediate side of the coding path, which is arranged between the opposing sides, defines the bottom of the channel and/or the top of the ridge. The depth and/or height of this intermediate side may vary along the course of the coding path. Also the cross-section of the coding path may vary along its course, such that the form of the opposing and/or intermediate sides varies.

Provision of at least one coding path has the advantage that it may serve as a guide for the validating means of the key, such that insertion of the key into the lock is facilitated.

A key body part which is provided with the coding cavity may be made of a single body part (single piece body part). The whole key which may include the key body part and a handle part or section may be made of a single piece. In an alternative, the key body part may be made of a plurality of key body sub-parts.

The key body part or the key as whole may be free of any movable part.

The key body part may be provided with a cylinder shape. The cross-section of the cylinder may be one of: circle, triangle, rectangle, and ellipse.

The key body part provided with the coding cavity may be an essentially closed body with regard to side walls, while a front opening into the coding cavity is provided on a front side of the key body part.

A tip portion of the coding cavity may be free of any key coding structure or coding means. In conclusion, in this embodiment at least the internal undercut is located outside the tip portion.

The key may comprise at least one channel arranged within the at least one coding cavity, the at least one undercut being formed by a portion of the at least one channel.

The shape and/or dimension of the channel may vary along the course of the channel.

The key may comprise at least two channels, which are arranged within the at least one coding cavity and which have intersecting or separate courses.

The at least one coding cavity may be formed in a key body which may also referred to as key body part, which comprises one or more holes, which extend from the inside of the at least coding cavity through the key body to the outside.

The key may comprise a key body which has an external geometry for an additional coding of the key. The external geometry may comprise dimples, holes, teeth and/or grooves. In an alternative, the key body may be provided with a flat external surface.

The key may further comprise a part, which is arranged movably with respect to a key body and which serves for an additional coding of the key. The movable part may be provided with at least one of a pin, a disc, and a spring.

The key according may comprise at least one of an electronic, a biometric, a magnetic and/or a photo sensor for an additional coding of the key.

The key may have a first end, in which the at least one coding cavity is formed, and a second end, which comprises an additional coding of the key, the first and second ends being insertable into a lock.

The key may be made at least partially of metal, ceramic and/or plastic.

At least one of mechanical, electrical, electronic, magnetic and optical means may be used for validating the key.

The undercut may be built in a wall of a key body part in which the coding cavity is provided, so that, when looking in the extension of the direction in which the coding cavity extends, a rearward portion of the wall is hidden behind a forward portion of the wall. The internal undercut may be configured as defined while looking in the extension of the direction through a front opening or a side wall opening of the coding cavity.

The hollow geometry may extend axially and/or radially in relation to the coding cavity.

The hollow geometry, specifically the internal undercut, may be provided with at least one of a protruding structure and a groove structure. The protruding structure and/or the groove structure may extend along a wave line, the wave line having at least one of sinus line and a non-sinus line. The protruding structure and/or the groove structure may extend along a channel, optionally provided with crossing channel sections. Along its extension the channel's shape may vary, e.g. with regard to at least one of channel depth and channel width.

At least one of the protruding structure and the groove structure may be provided with crossing sections.

The hollow geometry, specifically the internal undercut, may extend symmetrically to a longitudinal axis of the coding cavity.

The hollow geometry, specifically the internal undercut, may be provided with one or more curved section e. g. a section extending along an arc. Adjacent sections of a curved coding structure may be provided with a different angle in relation to the longitudinal axis of the coding cavity. Adjacent sections may be provided with a positive and a negative angle, respectively, in relation to the longitudinal axis of the coding cavity. The positive and the negative angle may be of the same or different value. The adjacent sections may be provided along a wave line, the wave line having at least one of sinus line and a non-sinus line.

The internal undercut may be configured to receive or to engage with validating means of the look, the validating means being movable between an extended and a non-extended position. There may one or more telescopic pins.

The key may be a double-side key comprising a first and a second key body part provided on opposite sides of a key handle section, the first and second key body part each being provided with a key coding structure. The key coding structure, on one side or on both sides, may be provided with a coding cavity defining a hollow geometry for coding the key.

The coding cavity may be provided with a cylinder shape. The cross-section of the cylinder may be one of: circle, triangle, rectangle, and ellipse. The coding cavity may also be provided with a non-cylindrical shape, e.g. a cruciform shape.

For coding the key, the coding cavity internally may be provided with at least one of: a discontinued groove, an internal bitting, an internal boring, and an internal cam profile. The internal bitting may be provided with a 3D structure, bittings different with regard to at least one of profile, depth, and size. The bittings may be adapted to engage with one or more rotating pin. A multiple depth cavity may be provided, thereby, the key being adapted for use with telescopic pins.

The key body part may be provided with a slit overlapping with the coding cavity and the hollow geometry. The slit, at least in part, may extend through the coding cavity.

For manufacturing the key an additive manufacturing process may be used. Additive manufacturing allows intricate features of great complexity to be produced, even in the internal areas. For example, selective laser melting (SLM) is used, in which the geometry of the key is built by the combination of powder material and laser power in a layer by layer basis. Other possible additive manufacturing processes make use of at least one of laser sintering, laser melting, electron beam melting, fused deposition modeling, material jetting, photopolymer jetting, binder jetting, stereolithography and injection. The additive manufacturing process allows the creation even of highly complex internal structures. Thus, it is possible to provide a set of multiple keys each having a unique coding, which cannot be duplicated by conventional methods and therefore guarantees a high security level.

Following, further embodiments with regard to the lock are described.

The validating means of the lock may comprise at least one follower element, which is movably arranged so as to engage the at least one follower element with at least one coding path of the key and to follow it, as the key is inserted into the key cavity.

The key may be insertable into the key cavity by moving it in a linear direction, wherein the at least one follower element is movable in a plane transversely to the linear direction.

The lock may be configured such that the driver part is rotatable when a key with the correct coding is inserted into the key cavity of the lock and subsequently rotated.

The validating means may be movable with respect to the housing.

The validating means may comprise at least one follower element, which is movably arranged on a stator and which is preferably disk-shaped.

The follower element may comprise at least one protrusion contacting the coding cavity when the key is inserted.

In the unblocking state the validating means may comprise a part which is rotatable around a stator.

The blocking means may comprise a mechanical component and the follower element comprises at least one notch for receiving a portion of the mechanical component.

The blocking means comprises a bar which in the unblocking state is movable between a groove built in a stator and a groove built in the validating means.

The lock may comprise prestressing means for urging the bar into the groove of the stator.

The blocking means comprise follower elements arranged between spacer elements, in the blocking state the spacer elements being arranged immovably and the follower elements being arranged movably on a stator.

The spacer elements may comprise engagement means for engagement in the key.

The key cavity may have an annular cross-section for receiving the portion of the key comprising the coding cavity.

BRIEF DESCRIPTION OF THE DRAWINGS

Following, further embodiments are described with reference to Figures. In the drawings:

FIGS. 39*a-d* show various views of another key provided with at least one internal undercut;

FIGS. 40*a-d* show various views of an additional key provided with an internal undercut;

FIGS. 43*a-d* show various views of a key having internal undercuts;

FIGS. 44*a-d* show various views of a key having a slightly different design compared to the key in FIG. 43;

DESCRIPTION OF EMBODIMENTS

Figure 1:
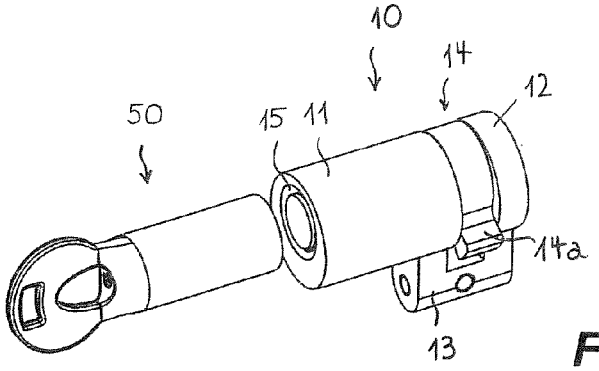
FIG. 1 shows an assembly of a lock and a key according to the invention in a perspective view.

FIG. 1 shows a lock 10 together with a key 50. The lock 10 comprises a housing 11 enclosing the validating means for validating the key 50, an end plate 12 connected to the housing 11 via a bridge element 13 and a driving element 14 with a cam 14*a*, which is arranged between the spacing of the housing 11 and the end plate 12. If the correct key 50 is inserted, the driving element 14 can be rotated to unlock or lock the actual locking mechanism, e.g. a bolt of a door or the like.

The lock 10 is designed such that a key 50 with a hollow geometry can be inserted. To this end, the lock 10 has a key cavity 15 which surrounds the validating means. The key cavity 15 has an annular form for receiving a portion of the key, in which a coding cavity is formed (see e.g. the coding cavity 55 in FIG. 11).

Figure 2:
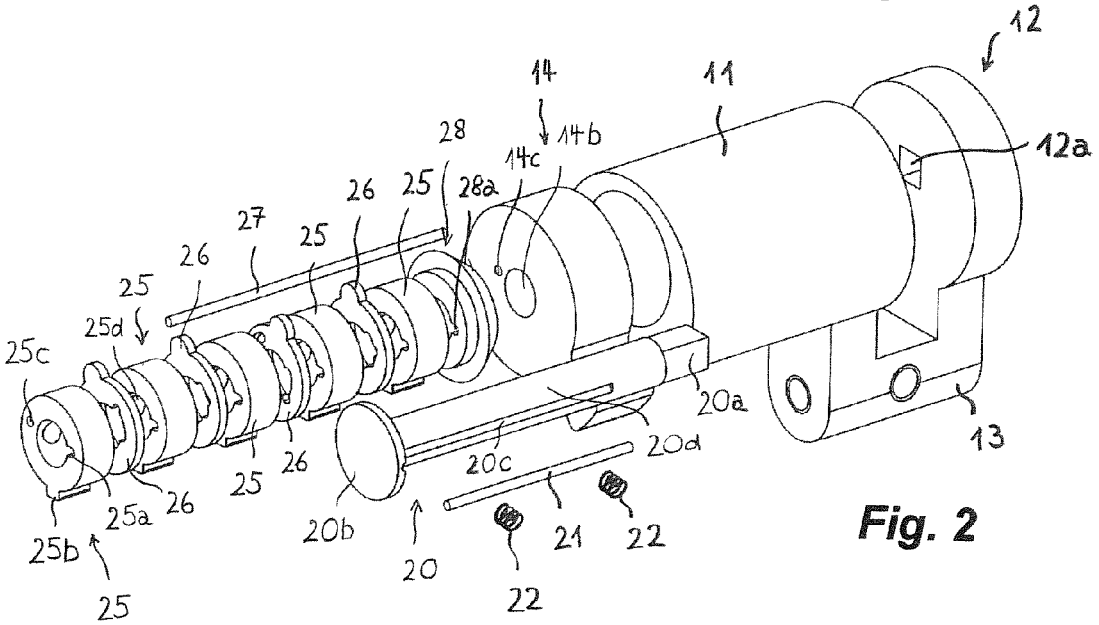
FIG. 2 shows an exploded view of the lock according to FIG. 1.

FIG. 2 shows the various components of the lock 10. The latter comprises a stator 20, which in the assembled state extends through the housing 11 and the driving element 14 into a hole 12*a* formed in the end plate 12. The stator 20 is in the form of rod whose one end is provided with a stopper plate 20*b* and whose other end 20*a* is provided with a non-circular cross-section which has a complementary form with respect to the hole 12*a*. Thus in the assembled state, the stator 20 is firmly fixed with the end plate 12 and forms the stationary component around which the key together with components of the validating means can rotate.

The stator 20 has a groove 20*c* which extends alongside of the middle portion 20*d* of the stator 20 and which serves for receiving a blocking element 21. The latter is for instance formed as a sidebar which is pushed into the groove 20*c* by using elastic means, e.g. one or more springs 22.

The lock 10 further comprises spacer elements 25 and follower elements 26, which—in the assembled state—are arranged alternately side by side on the stator 20. Each spacer element 25 is formed as a ring such that the stator 20 can extend therethrough, and has

- a notch 25*a* extending axially along the inside of the ring for receiving part of the blocking element 21,
- a protrusion 25*b* extending axially along the outside of the ring, and
- a hole 25*c* extending axially through the ring for receiving a portion of an alignment element 27, which is e.g. formed as a bar.

The protrusions 25*b* engage with a groove 59 formed in the key 50 (see FIGS. 11 and 12) when the latter is inserted into the key cavity 15 of the lock 10. Provision of the protrusions 25*b* is optional. In another embodiment some or all of the spacer elements 25 do not have a protrusion 25*b*. In this case, the outer surface of a spacer 25 is cylindrical.

Some of the spacer elements 25 have a blind hole 25*d* which extends radially from the inside of the ring outwards and which form a chamber for receiving a spring 22.

The lock 10 further comprises an end element 28, which serves as a stopper and which—in the assembled state—lies against the driving element 14. The end element 28 has a hole (not visible in FIG. 2) which extends therethrough to receive a portion of the alignment element 27 and a notch 28*a* similar to the notch 25*a* of the spacer element 25.

The driving element 14 has a first hole 14*b* through which the stator 20 can extend and a second hole 14*c* for receiving a portion of the alignment element 27.

Figure 3:
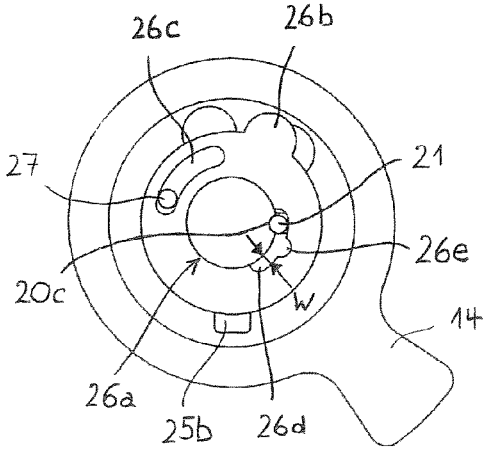
FIG. 3 shows a front view of the lock according to FIG. 1 when being in a blocking state, wherein the housing is not shown.

Each follower element 26 has a disk-like form and comprises (see also FIG. 3)

- a hole 26*a* extending axially through the element 26,
- a protrusion 26*b* extending radially outwards, and
- a slit 26*c* which extends in a curved way so that the follower element 26 can be rotated relatively to the alignment element 27 going through the slit 26*c*.

The hole 26*a* has a circular cross-section which is expanded along a given angle range to form a recess 26*d* provided with a notch 26*e* for the blocking element 21. The recess 26*d* is curved and has a width w which is chosen such that the blocking element 21 can only engage partly into the recess 26*d*. This width is enlarged at the position of the notch 26*e* so that the blocking element 21 can completely engage into the notch 26*e*. The angle between the position of the protrusion 26*b* and the position of the notch 26*e* defines the uniqueness of the lock, i.e. different locks can be provided by choosing this angle differently.

Figure 5:
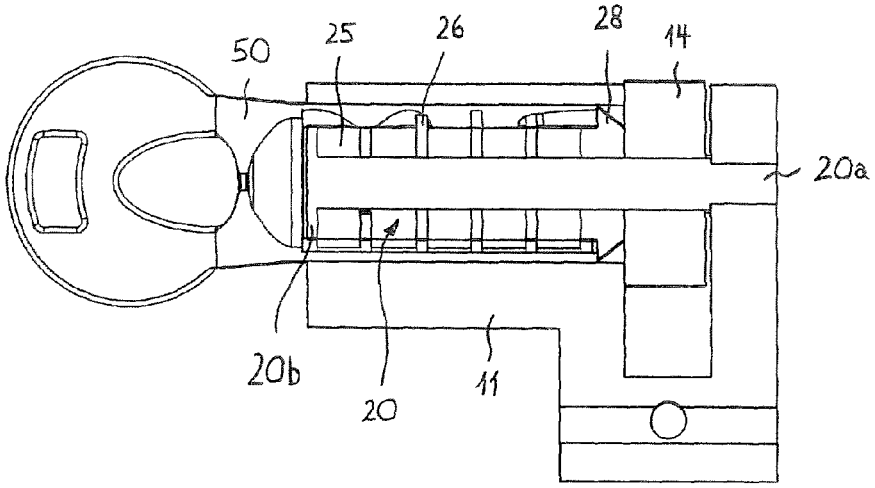
FIG. 5 shows the key inserted into the lock according to FIG. 1 in a sectioned side view.

In the assembled state of the lock 10, the spacer elements 25 and the follower elements 26 are arranged on the stator 20 and between the stopper plate 20*b* and the end element 28 (see also FIG. 5). The alignment element 27 extends through the holes 25*c* of the spacer elements 25 and the slits 26*c* of the follower elements 26 and through the end element 28 into the driving element 14. Thereby, the alignment element 27 connects non-rotatably the spacer elements 25 and the end element 28 with the driving element 14. The blocking element 21, which extends from the outermost spacer element 25 to the end element 28, is pushed by means of the elastic means 22 into the groove 20*c* of the stator 20, whereby the rotation of the elements 14, 25, 27, 28 is blocked. Due to the slit 26*c* and the recess 26*d*, each follower element 26 can be rotated with respect to the stator 20 and the elements 14, 25, 27, 28.

Figure 4:
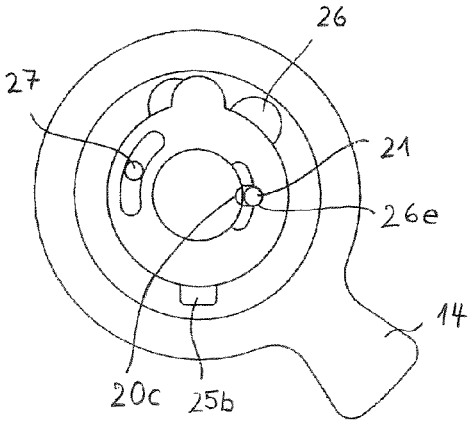
FIG. 4 shows a front view of the lock according to FIG. 1 when being in an unblocking state, wherein the housing is not shown.

As explained below, a key 50 provided for the lock 10 has for instance an internal channel defining a specific path. Due to this geometry, the insertion of the key 50 causes the follower elements 26 to follow the internal path in the key angularly by a corresponding rotation. The follower elements 26 will be arranged at a certain rotational position when the key has been completely inserted. If the key 50 is not correct, then the blocking element 21 remains in the groove 20*c* so that the elements 14, 25, 27, 28 and the key 50 cannot be turned. If a correct key 50 is inserted, then all follower elements 26 are rotated such that the notches 26*e* in the perimeter line up. These lined-up notches 26*e* form together with the notches 25*a* and 28*a* a continuous side groove into which the blocking element 21 can be received, as shown in FIG. 4. Subsequent rotation of the key 50 exerts a torque on the elements 25, 26 which counteracts the force of the elastic means 22 so that the blocking element 21 is released out of the groove 20*c* and pushed into the continuous side groove mentioned above. Finally, this allows the elements 14, 21, 22, 25-28 together with key 50 to be rotated with respect to the stator 20.

The lock 10 is locked again by rotating the key 50 and with it the elements 14, 21, 22, 25-28 into the other direction, so that the blocking element 21 can slide back into the groove 20*c*. Withdrawal of the key 50 causes the follower elements 26 to be returned back to the "zero" position, in which the notches 26*e* are not lined up anymore.

Figure 6:
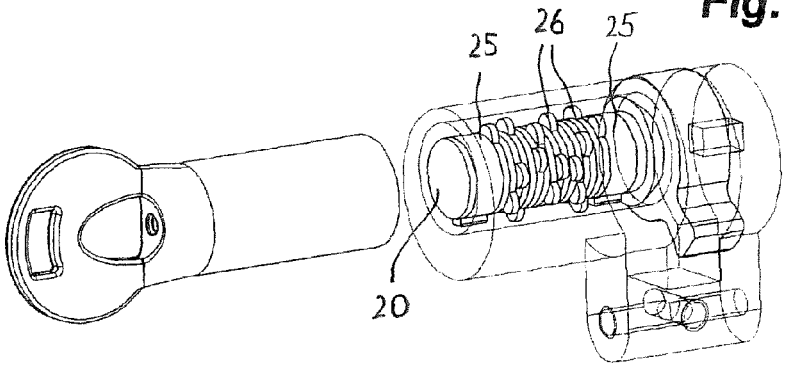
FIG. 6 shows a variant of an assembly with lock and a key according to the invention in a perspective view.
Figure 7:
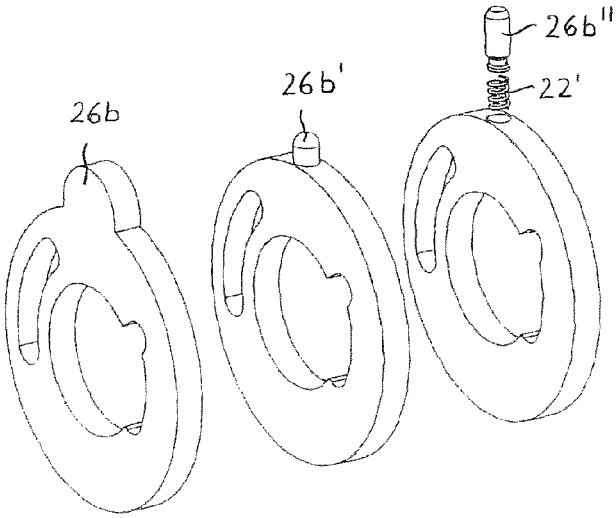
FIG. 7 shows a perspective view of three variants of a follower element for a lock according to the invention.
Figure 8:
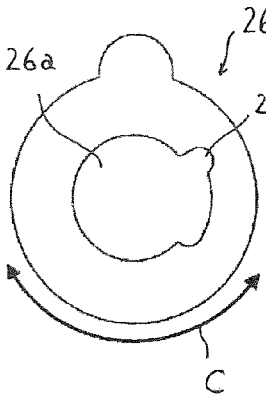
FIGS. 8 to 10 shows other variants for a follower element in a front view.
Figure 9:
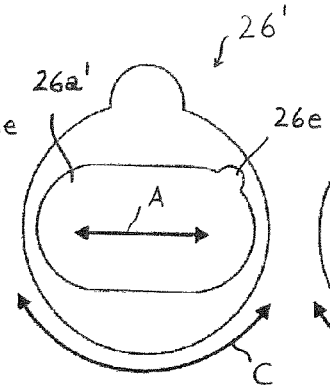
Figure 10:
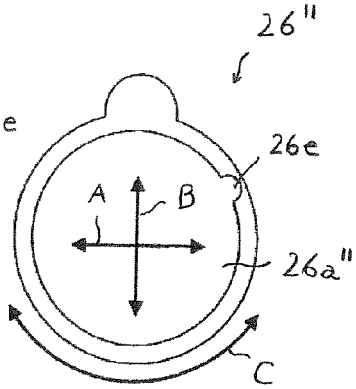

Different variants of the embodiment shown in FIG. 2 are conceivable:

- The blocking means between the stator 20 and the rotating part can be designed differently. For instance more than one blocking element may be provided for. The blocking element may have another shape than a bar.
- The number of follower elements 26 is freely choosable. FIG. 6 shows an example, wherein a multiple of follower elements 26 is arranged between two spacer elements 25. Increasing the number of follower elements 26 allows an increase in the number of unique locks.
- The protrusion of the follower element 26 may be circular (see protrusion 26*b*' in FIG. 7), square, cylindrical (see protrusion 26*b*' in FIG. 7) or may be of any other shape profile that ensures a following of the path in the key 50. The protrusion may also be movably arranged on the follower element to allow a three-dimensional following of a more complex path in the key, such as for example a path with bumps of varying depths (see the right-hand side of FIG. 7 showing a follower element with a pin 26*b*" and a spring 22' for acting on the pin 26*b*", such that it is movable in the radial direction.)
- The lock is designed such that the follower element can be moved in at least one rotational and/or translational axis. FIG. 8 shows the follower element 26 of the embodiment of FIG. 2, wherein it can be rotated around the key axis as indicated by arrow C. FIG. 9 shows a follower element 26' which, in addition to the rotational movement, can be displaced along an axis normal to the key axis as indicated by arrow A. To this end, the shape of the hole 26*a*' is enlarged in the A-direction. FIG. 10 shows a follower element 26" which, in addition to the rotational movement, can be displaced along two axes normal to the key axis as indicated by arrows A and B. To this end, the shape of the hole 26*a*" is enlarged in the A- and B-direction.

Figure 11:
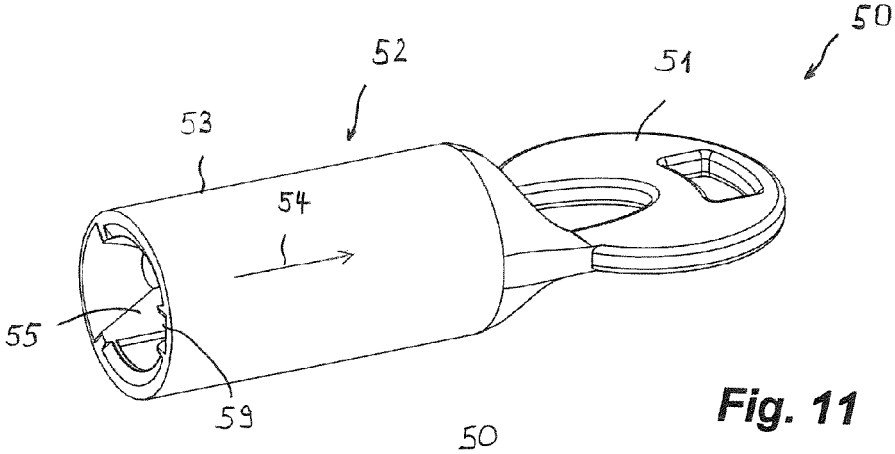
FIG. 11 shows the key of FIG. 1 in a perspective view.
Figure 12:
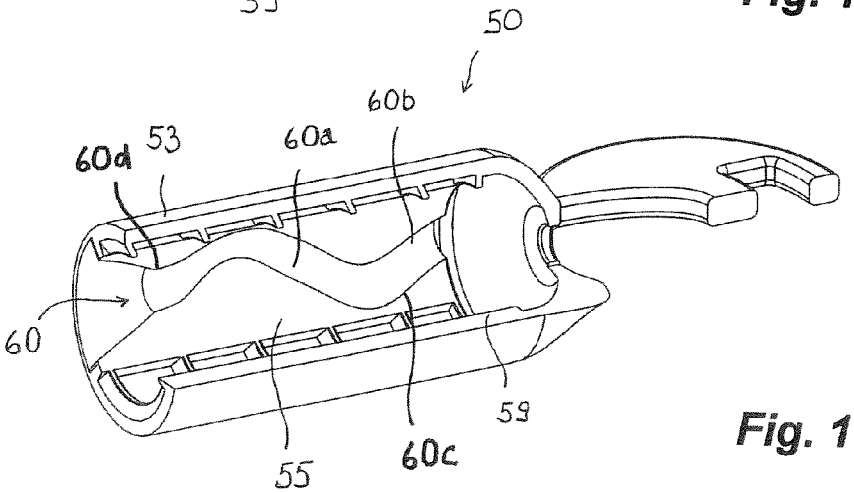
FIG. 12 shows the key of FIG. 11 partially sectioned.
Figure 13:
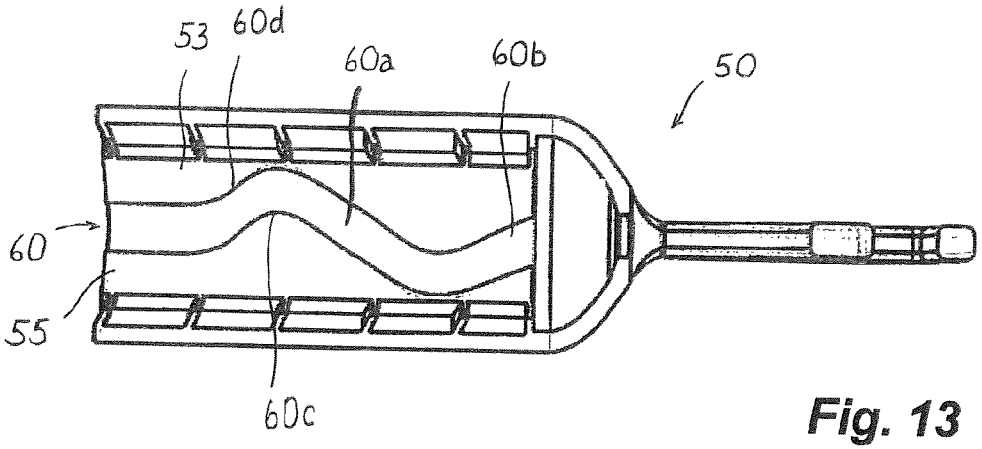
FIG. 13 shows a sectioned side view of the key according to FIG. 11.

FIGS. 11 to 13 show different views of a key 50 for the lock 10 of FIG. 2. The key 50 has a handling part 51 and a key body 52 with a coding cavity 55 defining a hollow geometry. This geometry defines a specific coding of the key 50, which is validated when used with the lock 10. The geometry comprises at least one undercut built in the wall 53 of the key body 52, so that, when looking in the extension direction 54 in which the coding cavity 55 extends, a rearward portion of the wall 53 is hidden behind a forward portion of the wall 53. Thus, the geometry of the rearward wall portion cannot be seen when looking in the extension direction 54. The geometry may be formed in the wall 53 of the key body 52 as negative and/or positive portions, i.e. as portions, which are formed as recesses in the wall 53 and/or as parts protruding out of the wall 53 into the coding cavity 55.

The key 50 shown in FIGS. 12 and 13 comprises a coding path in form of a channel 60 which is formed at the inside of the wall 53 and which extends from the forward end of the coding cavity 55 towards the rearward end of the coding cavity 55. The channel 60 is defined by two sides 60*c* and 60*d*, which are arranged opposite to each other and which are made integral with the wall 53.

Here, the channel 60 is curved such that portions with undercuts 60*a*, 60*b* are formed. The wall portion defining the undercut 60*a*, 60*b* is non-circumferential, i.e. it does not extend 360 degrees around the extension direction 54 of the coding cavity 55. By inserting the key 50 into the lock 10, the follower elements 26 engage with the channel 60 and are rotated around the stator 20.

The inside of the wall 53 further comprises a straight groove 59 which extends from the forward end of the coding cavity 55 towards its rearward end. In FIG. 12 only one side part of the groove 59 is shown. When inserting the key 50 into the lock 10, the protrusions 25*b* of the spacer elements 25 engage with the groove 59, whereby the key 50 is guided and its insertion is facilitated. If the key 50 is correct, then it can be turned such that a torque will be exerted on the spacer elements 25 via the engagement between the protrusions 25*b* and groove 59.

Figure 14:
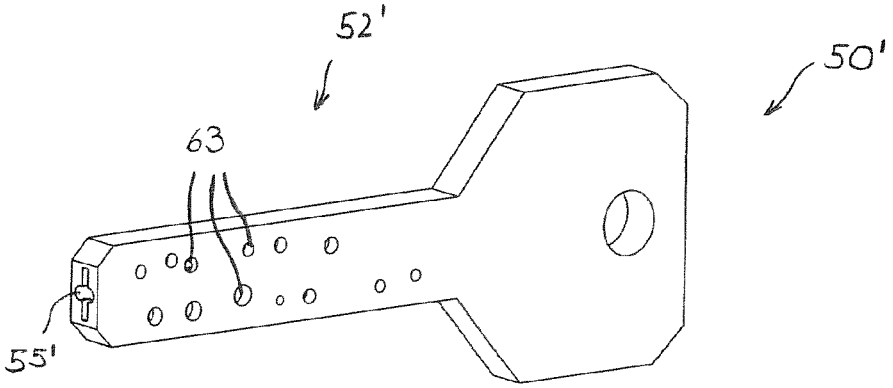
FIG. 14 shows another embodiment of a key according to the invention in a perspective view.
Figure 15:
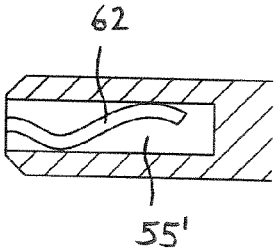
FIG. 15 shows a sectioned side view of the front part of the key according to FIG. 14.
Figure 16:
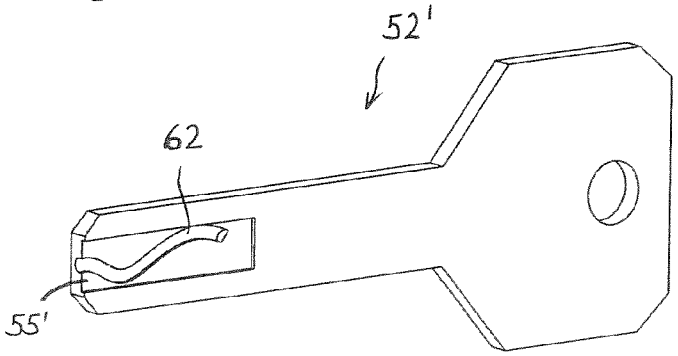
FIG. 16 shows the key of FIG. 14 sectioned along the middle plane.

FIGS. 14 to 16 show another embodiment of a key 50', wherein the key body 52' comprises a flat part with dimples 63 defining external security features, and a coding cavity 55' extending from the forward end of the key body 52' into its inside. The coding cavity 55' comprises a wall in which a channel 62 is formed, whose form defines one or more undercuts. The dimples 63 together with the channel 62 define the coding of the key 50'. In an alternative embodiment, the key 50' comprises several regions, in which coding cavities in form of the cavity 55' are formed.

A lock useable with the key 50' may comprise a conventional part as used in pin tumbler locks and an additional validating part. The latter comprises validating means, which protrudes into the key cavity of the lock so that it is introduced into the coding cavity 55', when the key 50' is inserted in the lock, in order to sense the inner face of the coding cavity 55'. In one embodiment, the validating means comprises a movable arm with a sensing head which can engage with the channel 62.

The geometry of the cavities 55, 55' and—if present—the dimples 63 serve as a coding by mechanical means. It is conceivable to add other security features in order to increase the level of security. This security features may be based e.g. on an electronic, optical, biometrical and/or magnetic validation.

Figure 17:
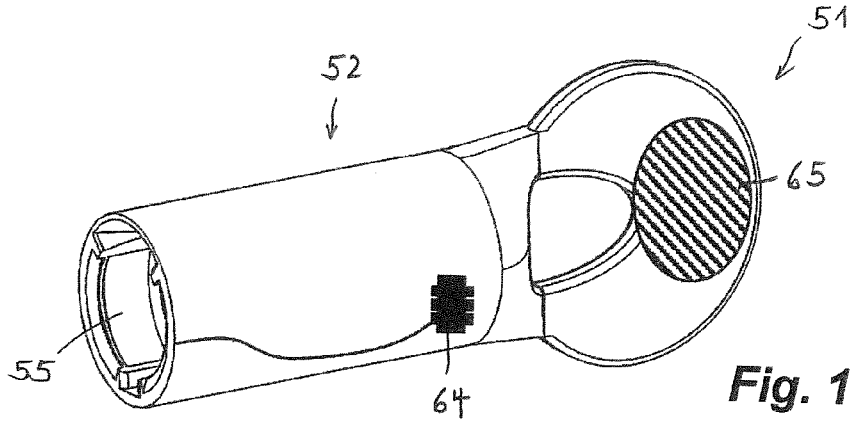
FIG. 17 shows another embodiment of a key according to the invention in a perspective view.

FIG. 17 shows a key comprising in addition to the coding cavity 55 an electronic part 64 arranged on the key body 52 and a biometric sensor 65 arranged on the handling part 51.

Figure 18:
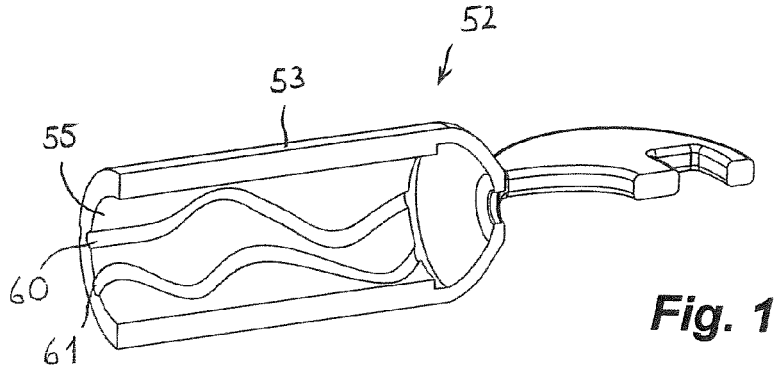
FIG. 18 shows a perspective view of another embodiment of a key according to the invention partially sectioned.
Figure 19:
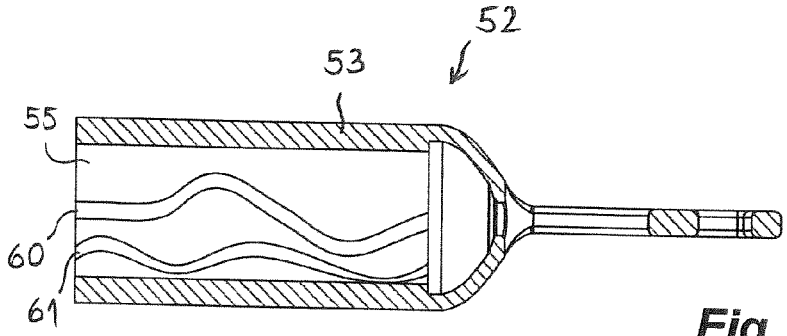
FIG. 19 shows the key of FIG. 18 in a sectioned side view.

Numerous embodiments are possible for defining a specific geometry of the coding cavity 55. FIGS. 18 and 18 show an example, wherein multiple channels 60, 61 are formed in the wall 53 of the key body 52. The number may be two or more.

Figure 20:
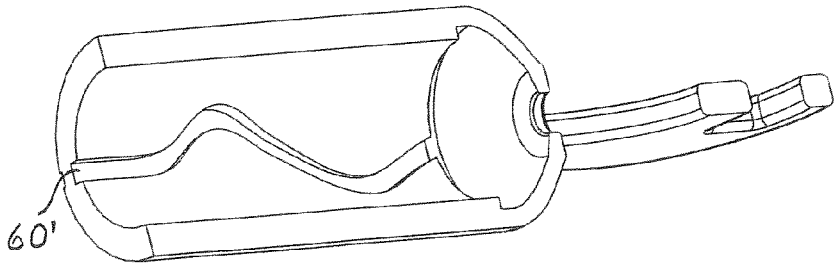
FIGS. 20 to 23 show each a perspective view of others embodiments of a key according to the invention partially sectioned.
Figure 21:
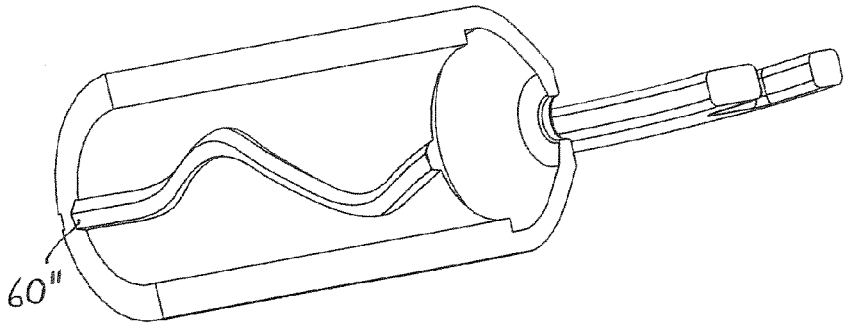

The cross-section of the channel(s) may be chosen arbitrarily, e.g. round, polygonal, etc. FIG. 20 shows an example, in which the channel 60' has a square cross-section. FIG. 21 shows an example, in which the channel 60" has a semi-hexagonal cross-section. Shape and/or dimension of the channel's cross-section may also vary along its course.

Figure 22:
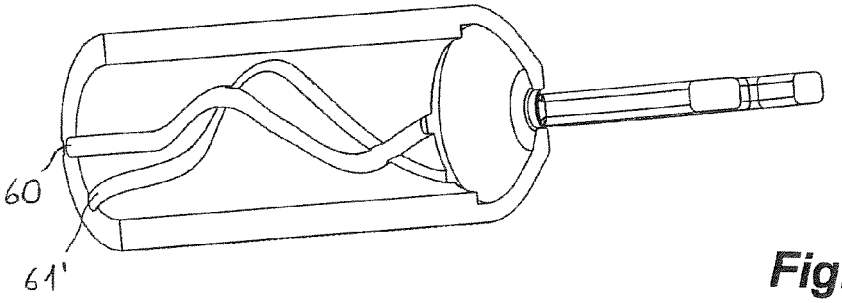
Figure 23:
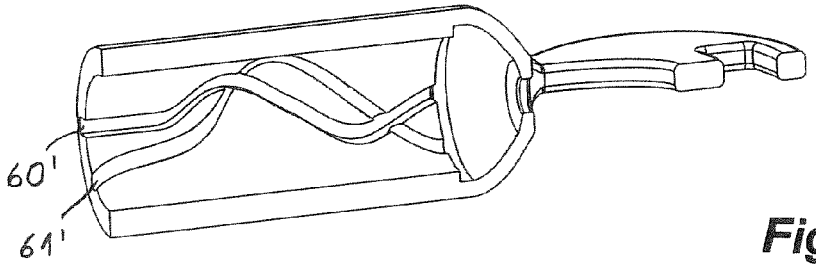

When providing multiple channels, crossings are also possible. FIG. 22 shows an example, in which the channels 60 and 61' intersect each other. FIG. 23 shows a similar example of two channels 60' and 61' intersecting each other. In these examples channels 60 and 61' have different depths as well as channels 60' and 61' have different depths.

Figure 24:
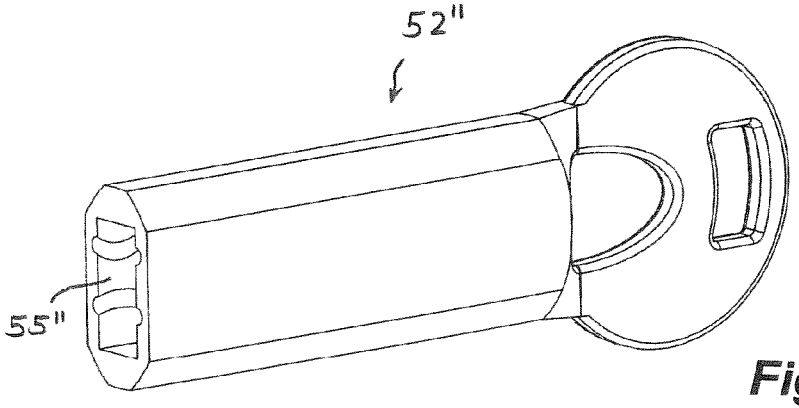
FIG. 24 shows a perspective view of another embodiment of a key according to the invention.

Furthermore, the shape of the key body can be chosen arbitrarily and may be cylindrical, polygonal, e.g. cubic, or of any other tubular shape. In FIG. 11 the key body 52 is cylindrical. In the example shown in FIG. 24 the key body 52" is flattened. The coding cavity 55', which is also flattened, defines—as in the example of FIG. 11—a specific hollow geometry with one or more internal undercuts.

Figure 25:
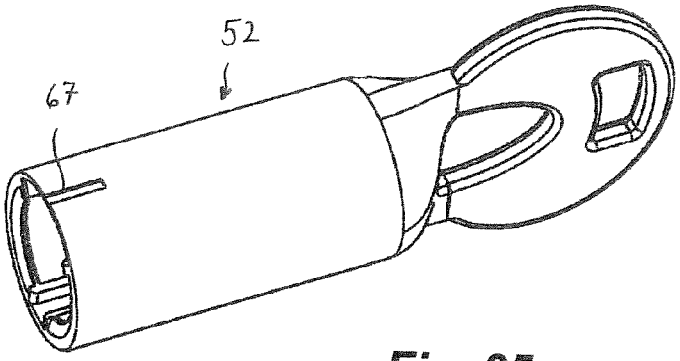
FIG. 25 shows a perspective view of another embodiment of a key according to the invention.
Figure 26:
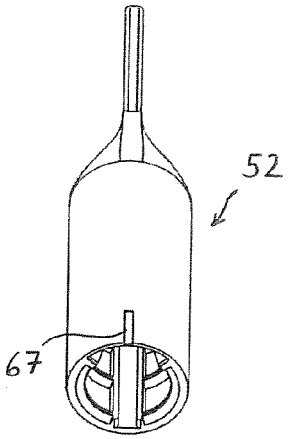
FIG. 26 shows the key of FIG. 25 in another perspective view.

In order to facilitate the insertion, the key may be provided with a visual positioning feature, which helps the user to easily orient the key with the correct orientation relative to the key cavity 15 of the lock 10. FIGS. 25 and 26 show an example, in which the key body 52 has a marking 67 at the front end, which corresponds to the top part of the key cavity 15 of the lock 10. Here, the marking 67 is formed as groove.

It is also conceivable to design the key such that there are two orientations possible for inserting and validating the key. In this case, the security features in the cavity 55 and—where present—on the key body 52, 52' are arranged symmetrically such that a validation is possible in a first orientation of the key and in a second orientation, which is turned around 180° from the first orientation.

Figure 27:
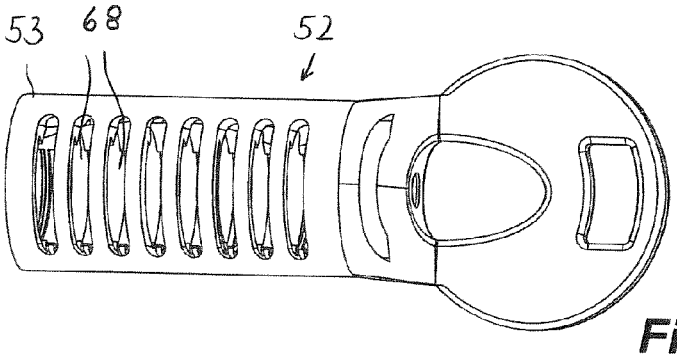
FIG. 27 shows a side view of another embodiment of a key according to the invention.
Figure 28:
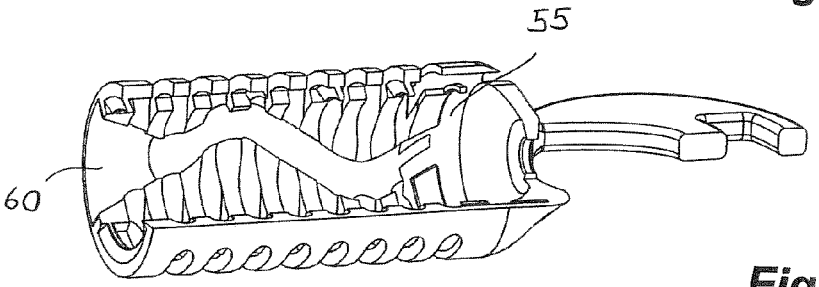
FIG. 28 shows a perspective view of the key of FIG. 28 partially sectioned.

Optionally, the key has exits to ensure that dust is easy to be removed and the geometry of the coding cavity does not clog. FIGS. 27 and 28 show an example, in which the key body 52 comprises slits 68, which go through the wall 53. The slits 68 are designed such that the channel 60 in the coding cavity 55 has still a continuous course or is one or more times interrupted.

Figure 29:
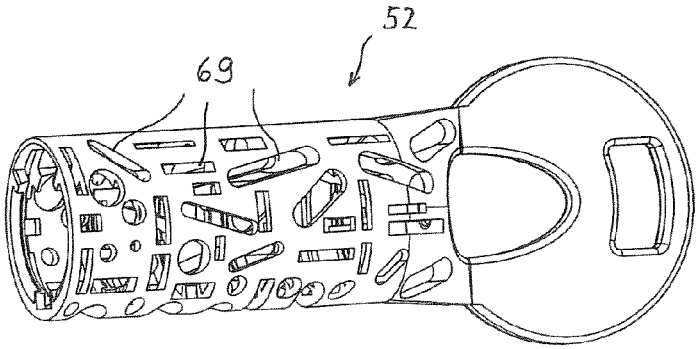
FIG. 29 shows a perspective view of another embodiment of a key according to the invention.

Optionally, the key has a skeleton like structure with many apertures. FIG. 29 shows a corresponding example, in which multiple apertures 69 are formed in the key body 52. Apart from ensuring cleanliness a weight reduction can be achieved.

Further embodiments are shown in FIGS. 30 to 46.

Figure 30:
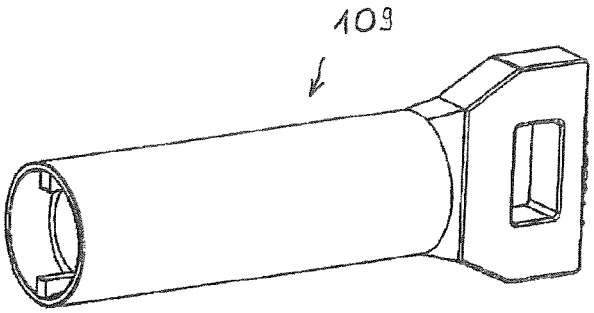
FIG. 30 shows a perspective view of another embodiment of a key according to the invention.
Figure 31:
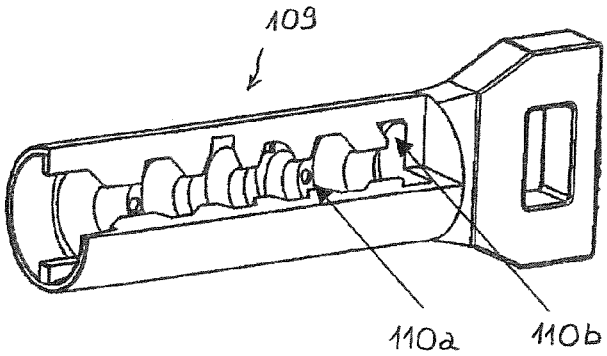
FIG. 31 shows a perspective view of the key of FIG. 30 partially sectioned.

FIGS. 30 and 31 show an embodiment of the security key in the shape of a hollow cylinder 109. The cylinder 1 carries the security features in its interior. FIG. 31 shows an example of possible solutions of internal features and shapes 110*a* and 110*b*.

Possible features are undercuts, holes, grooves, spirals or even free form shapes.

Figure 32:
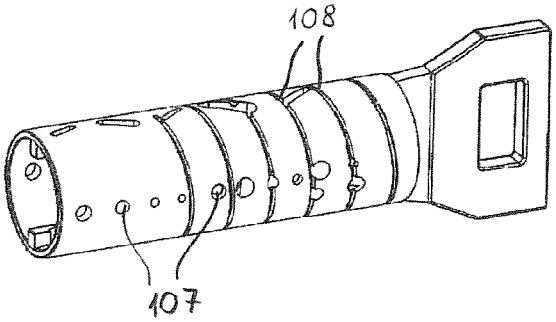
FIG. 32 shows a perspective view of another embodiment of a key according to the invention.

Some internal features might also penetrate the whole body or even create complex geometries such as grooves. FIG. 32 is a perspective view of a possible key geometry in which some of the internal features penetrate the whole body and are seen externally as holes 107 and grooves 108.

Figure 34:
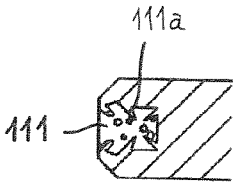
FIG. 34 shows a sectioned side view of the front part of the key according to FIG. 33.
Figure 33:
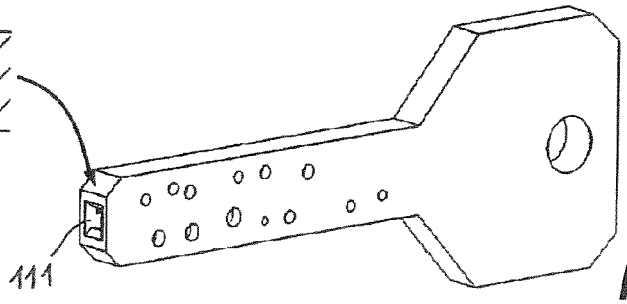
FIG. 33 shows a perspective view of another embodiment of a key according to the invention.

FIG. 33 is a perspective view of a possible key geometry in which a certain region 111 of the same is hollow and contains internal security features and undercuts (see the section view in FIG. 34). An undercut is formed by a non-circumferential wall portion 111*a*, which is made integral with the wall defining the cavity 111. Thus, the undercut extends less than 360 degrees around the wall to provide two ends spaced away. In the example of FIG. 33, an undercut extends in a straight direction.

Figure 35:
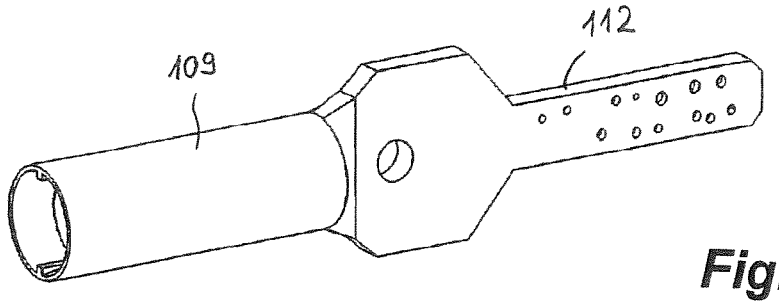
FIGS. 35 to 37 show each other embodiments of a key according to the invention in a perspective view.

Furthermore, the key may be a combination of the aforementioned security key and a standard key in a single body. FIG. 35 is a perspective view of a possible key geometry being a combination of a security key 109 and a standard key 112 in a single body.

Figure 36:
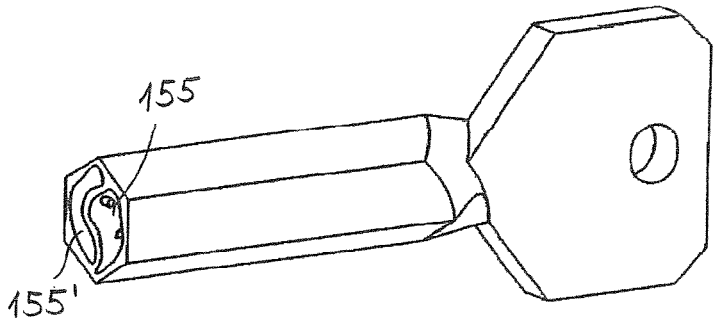

Additionally, the hollow shape of the key does not limit it to one single cavity: two or more cavities with internal features are also possible. FIG. 36 is a perspective view of a possible key geometry having two cavities 155, 155' with internal security features.

Figure 37:
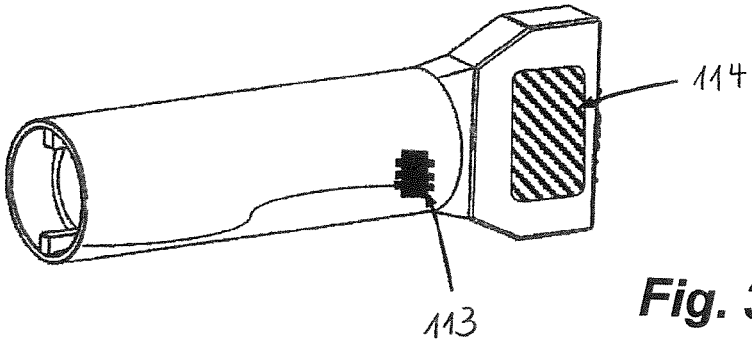

In addition, the key may be combined with an electronic, biometric, magnetic or photo sensor or a combination of some of them, to bring an additional level of security. FIG. 37 is a perspective view of a possible key geometry combined with an electronic/photo sensor 113 and a biometric sensor 114 to bring additional levels of security.

Figure 38:
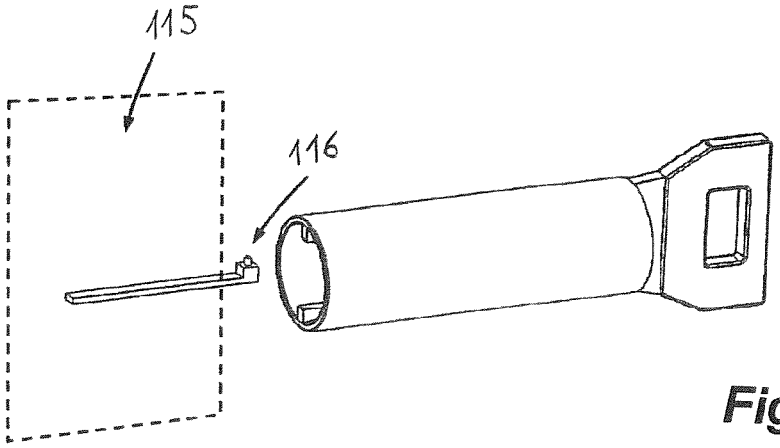
FIG. 38 shows a perspective view of the key of FIG. 30 together with a lock schematically indicated.
Figure 39A:
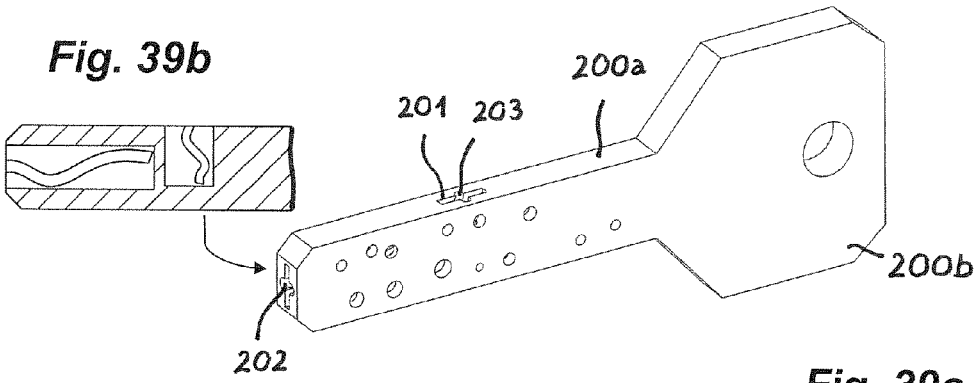
Figure 39C:
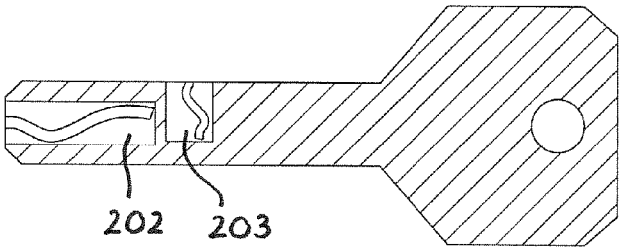
Figure 39D:
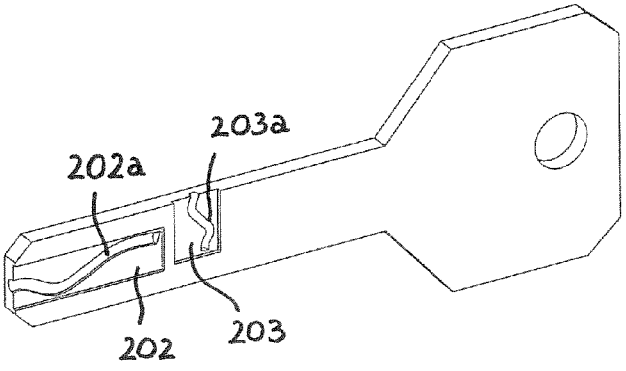

The counterpart of the key may validate the security features of the key by mechanical means, by conductivity measurements, magnetism and/or optical measurements. FIG. 38 is a perspective view of a possible key geometry being validated by for example a photo-sensor 116 located at an example of a corresponding lock 115.

The key described may provide for the following advantages:

The security features are hidden inside the hollow body and are therefore not easily accessible unless the key is cut. The copying of internal 3D features requires advanced optical measuring techniques. The manufacturing of duplicates by conventional methods is not possible. The manufacturing of duplicates requires additive manufacturing equipment which currently has a very high market price.

The lock of FIG. 2 is only one embodiment for validating the key. The lock may be designed such that the key can be validated by mechanical means, by conductivity measurements, magnetism, optical measurements or by any combination of these means.

FIGS. 39*a-d* show an additional embodiment of a key. A key body part 200*a* being made in a single piece with a key handle 200*b* is provided with a hollow geometry 201. Two separated coding cavities 202, 203 are present. Each of the coding cavity 202, 203 comprises at least one internal undercut 202*a*, 203*a*. The key shown in FIGS. 40*a-d*, compared to the key in FIGS. 39*a-d*, is provided with only one of the coding cavities, namely the coding cavity 203.

Figure 41A:
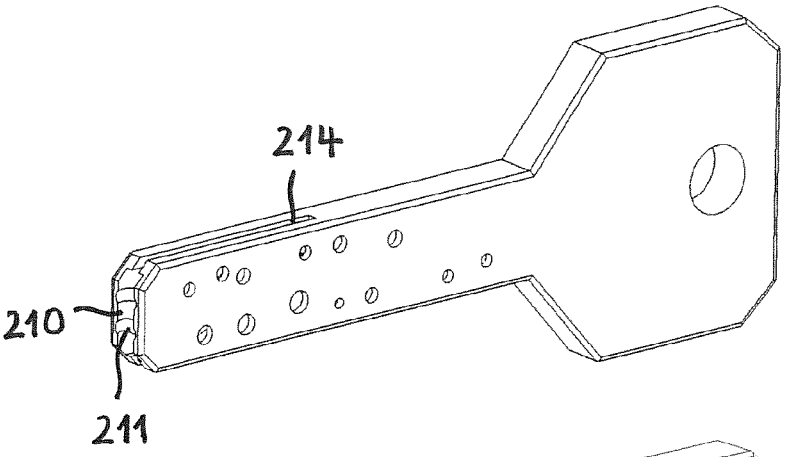
FIGS. 41*a-b* show a key, once without and once with parts of a lock provided with bar-wafers and a blocking bar.
Figure 41B:
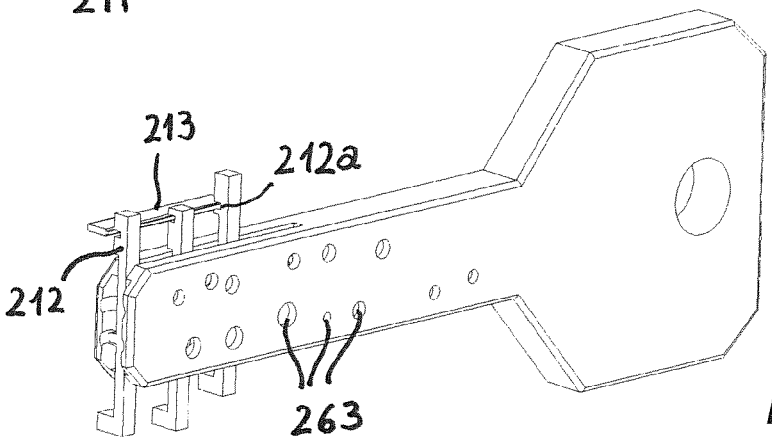

FIGS. 41*a-b* show a key provided with a coding cavity 210 comprising a hollow geometry 211. At least one internal undercut, which may be formed by a coding path having a non-straight course, is located in the hollow geometry 211. The key comprises a slit 214, which, at least in part, extends through the hollow geometry 211.

FIG. 41*b* shows also parts of a lock comprising validating means 212 and blocking means 213. The validating means comprise one or more follower elements 212, which are movably arranged on a stator (not shown). In the present example, three bar-wafers are shown as follower elements 212. The number may be one, two, three or more. Each follower element 212 is configured to sense the inner face of the coding cavity 210 and may comprise one or more protrusions, which are e.g. in the form of the protrusion 26*b*, 26*b*', 26*b*" shown in FIG. 7.

The blocking means comprise a blocking element 213, e.g. in the form of a blocking bar. Each follower element 212 comprises a groove section 212*a* for receiving a portion of the blocking element 213. In the blocking state, the blocking element 213 may be urged into a groove built in the stator in a similar way as the blocking element 21 of the lock in FIG. 2 is urged into the groove 20*c* of the stator 20 by means of the prestressing means 22.

As the key is introduced in the lock, the follower elements 212 extend through the coding cavity 210 and follow one or more coding paths of the hollow geometry 211. Thereby, each follower element 212 moves in a corresponding way in a direction transversally to the direction into which the key is introduced into the lock. In case, the key with the correct coding is used, the follower elements 212 will have the correct position so that the groove sections 212*a* are in line to form a groove into which the blocking element 213 can be received. The lock can then be brought into the unblocking state by rotating the key together with the elements 212, 213.

Figure 42:
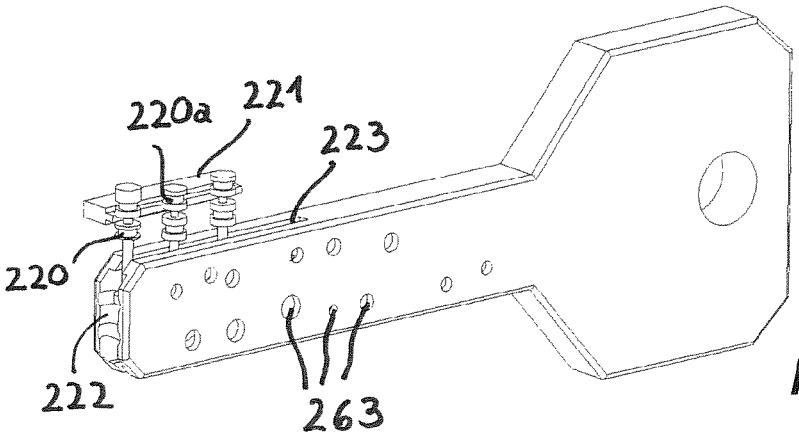
FIG. 42 shows a key having internal undercuts and parts of a lock provided with extended pins and a blocking bar.

FIG. 42 shows a key having one or more internal undercuts and parts of a lock comprising validating means 220 and blocking means 221. The validating means comprise one or more follower elements 220, which are movably arranged on a stator (not shown) and which may be in the form of pins. The follower elements 220 are configured to sense the inner face of the coding cavity 222. To this end, a follower element 220 may comprise one or more protrusions, which are e.g. in the form of the protrusion 26*b*, 26*b*', 26*b*" shown in FIG. 7.

The blocking means comprise a blocking element 221, which is arranged movably in a similar way as the blocking element 213 of FIG. 41*b*.

Each follower element 221 comprises several notches 220*a* along its axis. The depth of a notch 220*a* is chosen such that only one notch has a correct depth, whereas the others have a false depth.

As the key is introduced in the lock, the follower elements 220 extend through a slit 223 in the key so as to be partially received in the coding cavity 222 and to follow one or more coding paths of the key. Thereby, each follower element 220 moves in a corresponding way in a direction transversally to the direction into which the key is introduced into the lock. In case the key with the correct coding is used, the follower elements 212 will have the correct position so that all notches 220*a* with the correct depth are in line to form a groove into which the blocking element 221 can be received. The lock can then be brought into the unblocking state by rotating the key together with the elements 220, 221.

Depending on the actual configuration of the key, the parts of the lock shown in FIGS. 41*b* and 42 may be used in combination with further means for validating the key. For instance, the keys of FIG. 41*a* and FIG. 42 show also external security features, here in the form of dimples 263. Besides the elements 212, 213 or 220, 221, the validating and blocking means of the lock may have suitable components which allow a validation of the external security features 263, so that the lock can brought into the blocking or unblocking state when a key is used which has the correct coding with respect to the internal and external security features.

FIGS. 43*a-d* show a key having internal undercuts 230, 231 provided in two separated coding cavities 232, 233 of a hollow geometry 234 located in a key body part 235. Each undercut 230, 231 is formed by a non-circumferential wall portion, which is made integral with the wall defining the coding cavity 232, 233.

FIGS. 44*a-d* show a key having a slightly different design compared to the key in FIGS. 43*a-d*. The key shown in FIGS. 44*a-d*, compared to the key in FIGS. 43*a-d*, is provided with only one of the coding cavities, namely the coding cavity 233.

Figure 45A:
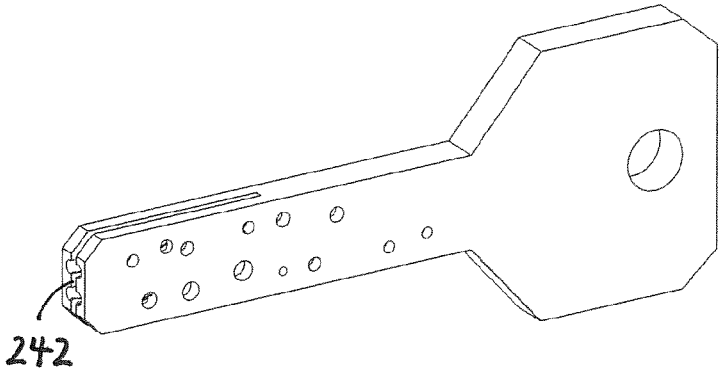
FIGS. 45*a-c* show various views of a key having internal undercuts extending from the front face.
Figure 45B:
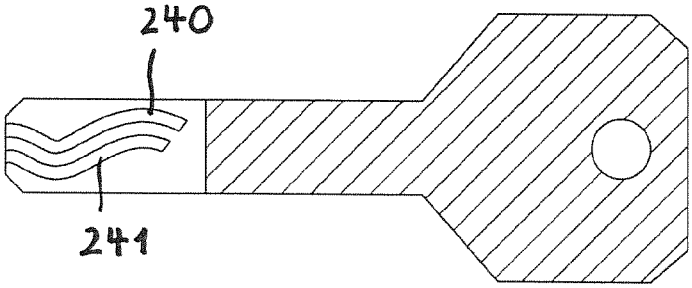
Figure 45C:
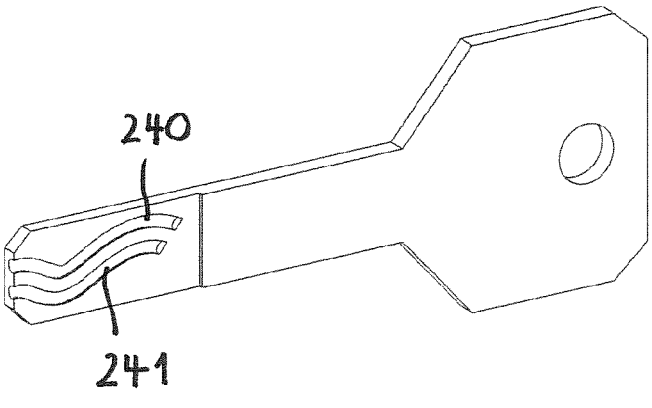

FIGS. 45*a-c* show a key having coding paths 240, 241, which define internal undercuts and extend from front face 243 of a coding cavity 242.

Figure 46A:
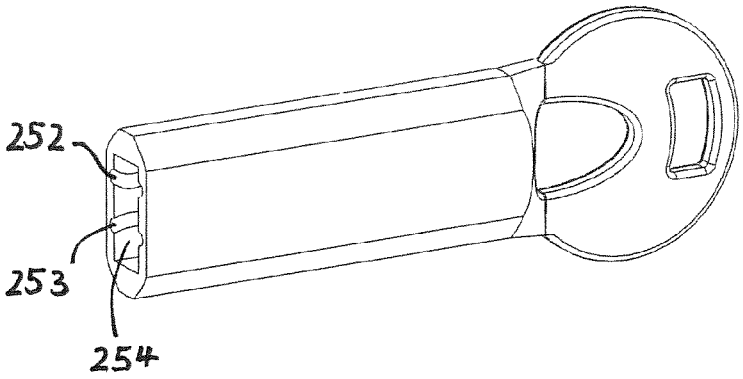
FIGS. 46*a-c* show various views of a key provided with an internal undercut comprising curved sections.
Figure 46B:
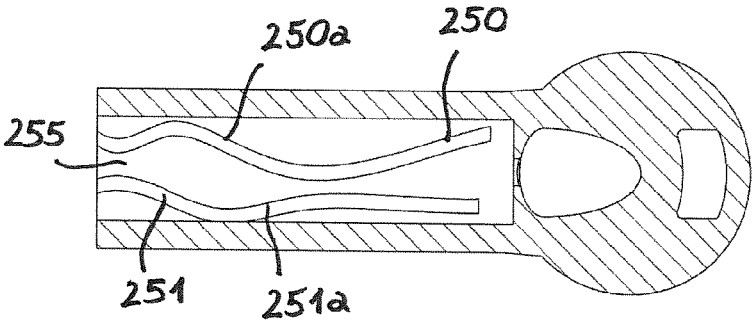
Figure 46C:
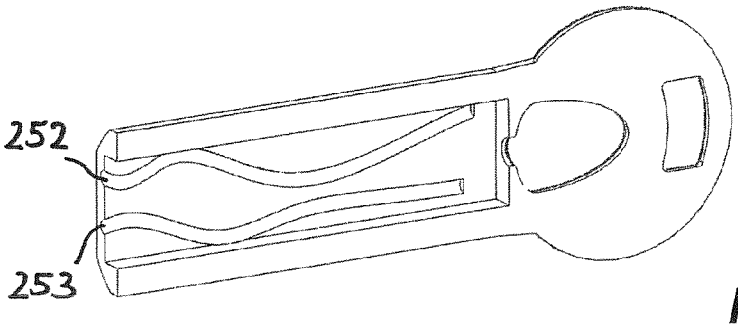

FIGS. 46*a-c* show a key provided with internal undercuts 250, 251 comprising curved sections 250*a*, 251*a*. The internal undercuts 250, 251 are provided in a respective coding path 252, 253 being in the form of a groove and extending from a front opening 254 of a coding cavity 255.

In at least some of the embodiments described so far, the key has a solid key body. It is also conceivable to design the key such that it comprises a movable part for an additional coding of the key. For example the key may comprise at least one movable pin and/or at least one movable disk. The movable part may be arranged externally and/or internally of the key body.

What is claimed is:

1. A key comprising:

a rigid hollow key body that includes at least one coding cavity defining a hollow geometry configured to code the key; and a wall with an inner side and an outer side opposed to the inner side, the inner side defining the at least one coding cavity extending in a first direction within the hollow key body, and the geometry including at least one internal undercut formed on the inner side of the wall, wherein the key body has a shape such that the at least one internal undercut is invisible from outside, the shape being different from a U-shape, the at least one internal undercut is made integral with the wall and extends, seen in a plane transverse to the first direction, less than 360 degrees around the first direction, and wherein the least one coding cavity is formed such that the at least one internal undercut is covered by a portion of said wall, the portion being spaced away from the at least one internal undercut in a direction transverse to the first direction.

2. The key according to claim 1, comprising at least one channel arranged within the at least one coding cavity, the at least one undercut being formed by a portion of the at least one channel.

3. The key according to claim 2, wherein the shape and/or dimension of the channel varies along the course of the channel.

4. The key according to claim 1, comprising at least two channels arranged within the at least one coding cavity and having intersecting courses.

5. The key according to claim 1, wherein the at least one coding cavity is formed in the key body, which comprises one or more holes, which extend from the inside of the at least coding cavity through the key body to the outside.

6. The key according to claim 1, wherein the key body has an external geometry for an additional coding of the key.

7. The key according to claim 1, further comprising a part movable with respect to the key body and configured to provide an additional coding of the key.

8. The key according to claim 1, further comprising a sensor providing an additional coding of the key, the sensor comprising at least one of an electronic sensor, a biometric sensor, a magnetic sensor, and a photo sensor.

9. The key according to claim 1, wherein the key has a first end containing the at least one coding cavity, and a second end configured to provide an additional coding of the key, the first and seconds ends being insertable into a lock.

10. The key according to claim 1, wherein the key is made at least partially of metal, ceramic and/or plastic.

11. The key according to claim 1, wherein the at least one internal undercut is integral with the wall.

12. The key according to claim 1, comprising at least one coding path defined by opposing sides, which extend in the at least one coding cavity from a first end to a second end along a non-straight course forming the at least one undercut, the second end being spaced away from the first end.

13. A lock configured to validate a key according to claim 1, the lock comprising:

a housing with a key cavity configured to receive the key;

a driving part configured to be moved when the key has the correct coding;

a blocker coupled to the driving part, the blocker having a blocking state in which movement of the driving part is blocked when the key has an incorrect coding, and an unblocking state in which the driving part is moved when the key has the correct coding;

a validator coupled to the blocker so as to change the state of the blocker when the has the correct coding;

the validator protruding at least partially into the key cavity and configured to be introduced at least partially into the coding cavity of the key and to sense the inner side of the wall defining the coding cavity, wherein the blocker comprises a bar that in the unblocking state is moved between a groove built in a stator and a groove built in the validator.

14. The lock according to claim 13, wherein the validator is movable with respect to the housing.

15. The lock according to claim 14, wherein the validator comprises at least one follower movably arranged on the stator.

16. The lock according to claim 15, wherein the follower comprises at least one protrusion contacting the coding cavity when the key is inserted.

17. The lock according to claim 16, wherein in the unblocking state the validator is comprised in a part rotatable around the stator.

18. The lock according to claim 17, wherein the blocker comprises a mechanical component and the follower comprises at least one notch positioned and configured to receive a portion of the mechanical component.

19. The lock according to claim 13, further comprising a prestresser configured to urge the bar into the groove of the stator.

20. The lock according to claim 13, wherein the blocker comprises a follower positioned between spacers, wherein in the blocking state the spacers are arranged immovably and the followers are arranged movably on the stator.

21. The lock according to claim 20, wherein the spacers comprise an engager configured to engage in the key.

22. The lock according to claim 13, wherein the key cavity has an annular cross-section configured to receive a portion of the key comprising the coding cavity.

23. The lock according to claim 13, wherein the key includes at least one coding path defined by opposing sides, which extend in the at least one coding cavity from a first end to a second end along a non-straight course for forming the at least one undercut, the second end being spaced away from the first end, wherein the validator comprises at least one follower movably arranged so as to engage the at least one follower with the at least one coding path of the key and to follow the at least one coding path, as the key is inserted into the key cavity.

24. The lock according to claim 23, wherein the key is inserted into the key cavity by moving the key in a linear direction, and wherein the at least one follower is movably arranged in a plane transverse to the linear direction.

25. A method of fabricating a key according to claim 1, wherein an additive manufacturing process is applied.

26. A method of validating a key according to claim 1, the method comprising validating the key by using at least one of a mechanical validator, electrical validator, electronic validator, magnetic validator and optical validator.

27. The key according to claim 12, wherein the sides are integral with the wall.

28. The key according to claim 6, wherein the external geometry comprises at least one of a dimple, a hole, a tooth, and a groove.

29. The key according to claim 1, comprising at least two channels arranged within the at least one coding cavity and having separate courses.

30. The key according to claim 15, wherein the at least one follower is disk-shaped.

31. The key according to claim 1, wherein the key comprises at least one coding path extending in the at least one coding cavity from a first end to a second end along a non-straight course for forming the at least one undercut, the second end being spaced away from the first end, wherein the at least one coding path includes ridge portions protruding of the wall.

32. The lock according to claim 13, wherein the validator comprises at least one follower element configured to contact the coding cavity when the key is inserted into the key cavity by moving it in an insert direction, the at least one follower element being arranged rotatably around the insert direction.

* * * * *